US008820026B2

(12) United States Patent
Underkofler et al.

(10) Patent No.: US 8,820,026 B2
(45) Date of Patent: Sep. 2, 2014

(54) CLIP FOR PERIMETER TRIM

(71) Applicant: USG Interiors, LLC, Chicago, IL (US)

(72) Inventors: Abraham M. Underkofler, Waukegan, IL (US); Peder J. Gulbrandsen, Aurora, IL (US); Mark R. Paulsen, Beach Park, IL (US)

(73) Assignee: USG Interiors, LLC, Chicago, IL (US)

( * ) Notice: Subject to any disclaimer, the term of this patent is extended or adjusted under 35 U.S.C. 154(b) by 0 days.

(21) Appl. No.: 13/756,561

(22) Filed: Feb. 1, 2013

(65) Prior Publication Data

US 2014/0215957 A1 Aug. 7, 2014

(51) Int. Cl.

| | |
|---|---|
| ***E04B 9/12*** | (2006.01) |
| ***E04B 9/18*** | (2006.01) |
| ***E04B 9/30*** | (2006.01) |

(52) U.S. Cl.

CPC ..... *E04B 9/30* (2013.01)
USPC ..... 52/712; 52/665; 52/506.07; 52/718.03; 52/718.04

(58) Field of Classification Search

CPC ..... E04B 9/067; E04B 9/127; E04B 9/30; E04B 2001/2415; E04B 2001/2457
USPC ..... 403/397; 24/289, 293, 295, 457, 581.11
See application file for complete search history.

(56) References Cited

U.S. PATENT DOCUMENTS

| | | | | |
|---|---|---|---|---|
| 3,333,387 | A * | 8/1967 | Deakins | 52/664 |
| 3,798,865 | A * | 3/1974 | Curtis | 52/665 |
| 3,898,782 | A | 8/1975 | Donato | |
| 4,464,074 | A * | 8/1984 | Green et al. | 403/192 |
| 4,663,911 | A * | 5/1987 | Gracia | 52/506.06 |
| 5,195,289 | A * | 3/1993 | LaLonde et al. | 52/506.06 |
| 5,551,792 | A * | 9/1996 | Witmyer | 403/241 |
| 5,572,844 | A * | 11/1996 | Stackenwalt et al. | 52/506.07 |
| 5,669,198 | A * | 9/1997 | Ruff | 52/656.4 |
| 5,937,605 | A * | 8/1999 | Wendt | 52/506.06 |
| 6,240,702 | B1 * | 6/2001 | Wilson | 52/749.1 |
| 7,429,023 | B2 * | 9/2008 | Morrow | 248/300 |
| 7,552,567 | B2 * | 6/2009 | Ingratta et al. | 52/506.07 |

(Continued)

FOREIGN PATENT DOCUMENTS

| | | |
|---|---|---|
| EP | 1 138 844 | * 10/2001 |
| FR | 1503759 | 12/1967 |

OTHER PUBLICATIONS

Compasso Elite Suspension Trim System Tip Sheet, 2 pgs., Copyright 2011, USG Interiors, Inc.

(Continued)

*Primary Examiner* — Robert Canfield
(74) *Attorney, Agent, or Firm* — Pearne & Gordon LLP

(57) ABSTRACT

A single piece sheet metal clip including a trim engaging part and a mounting part extending or extendable from the trim engaging part at a right angle, the trim engaging part having a limited height when the clip is tilted from a vertical portion and a height greater than the limited height when upright whereby the trim engaging part may be inserted between opposed channels on a rear side of a trim strip and upper and lower edges are trapped in a respective channel when rotated from the tilted position to an upright position, the trim engaging part having an integral element resiliently deflected in a channel when the clip is turned upright, said resilient element releasably locking the clip against a reversal of said movement and thereby maintaining the trim engaging part trapped in said channels.

4 Claims, 6 Drawing Sheets

(56) References Cited

U.S. PATENT DOCUMENTS

| | | | | |
|---|---|---|---|---|
| D612,224 | S * | 3/2010 | Wendt | D8/354 |
| 7,677,504 | B2 * | 3/2010 | Hutchinson et al. | 248/48.2 |
| 7,788,875 | B2 * | 9/2010 | Wendt | 52/712 |
| 7,930,864 | B2 | 4/2011 | Wendt | |
| 8,615,948 | B2 * | 12/2013 | Underkofler et al. | 52/506.07 |
| 2001/0032433 | A1 | 10/2001 | Harris | |
| 2003/0093969 | A1 * | 5/2003 | Saldana | 52/715 |
| 2007/0130869 | A1 | 6/2007 | Platt | |
| 2013/0227908 | A1 * | 9/2013 | Gulbrandsen et al. | 52/665 |
| 2014/0000205 | A1 * | 1/2014 | Underkofler et al. | 52/588.1 |

OTHER PUBLICATIONS

USG Corporation Compasso Elite Attachment Clip Standard, Drawing dated May 12, 2011 (2 sheets).

Notification of Transmittal of the International Search Report and the Written Opinion of the International Searching Authority, or the Declaration for PCT/US2014/012712, filed Jan. 23, 2014, International Search Report and Written Opinion of the International Searching Authority dated Jun. 3, 2014.

* cited by examiner

FIG. 1
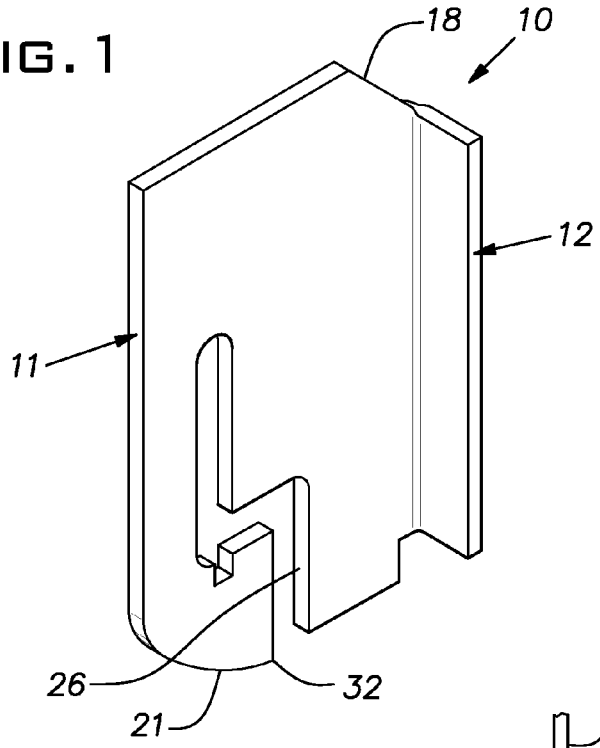
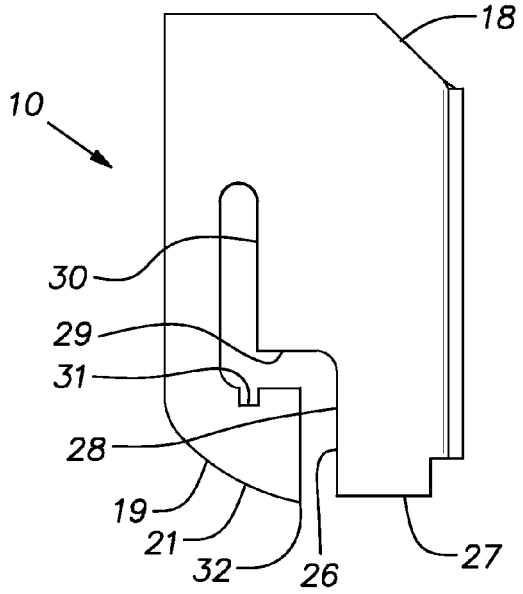
FIG. 2
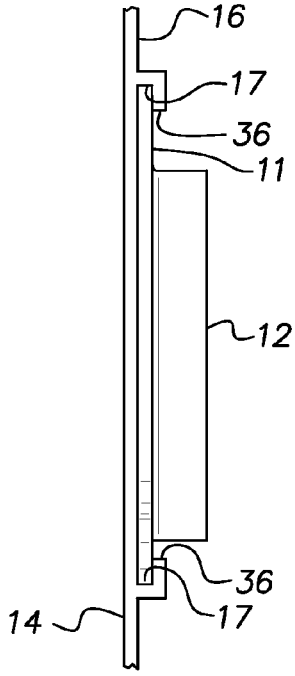
FIG. 3

FIG. 12
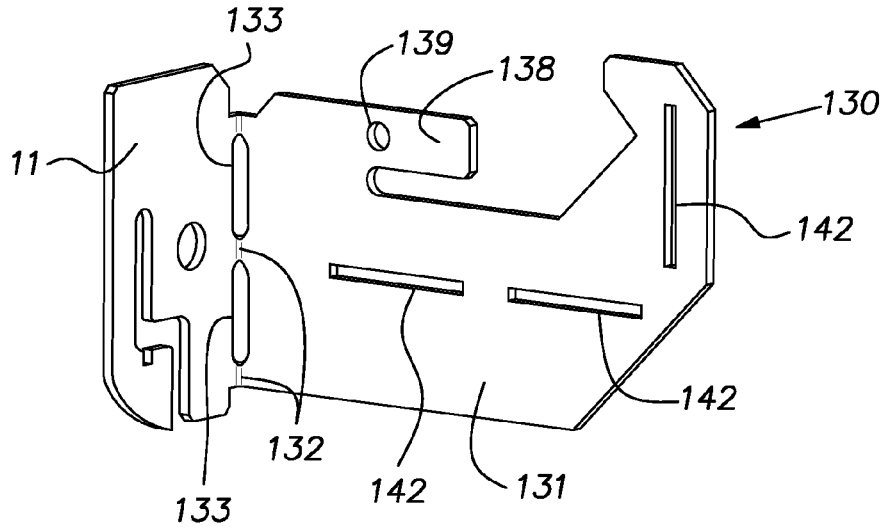
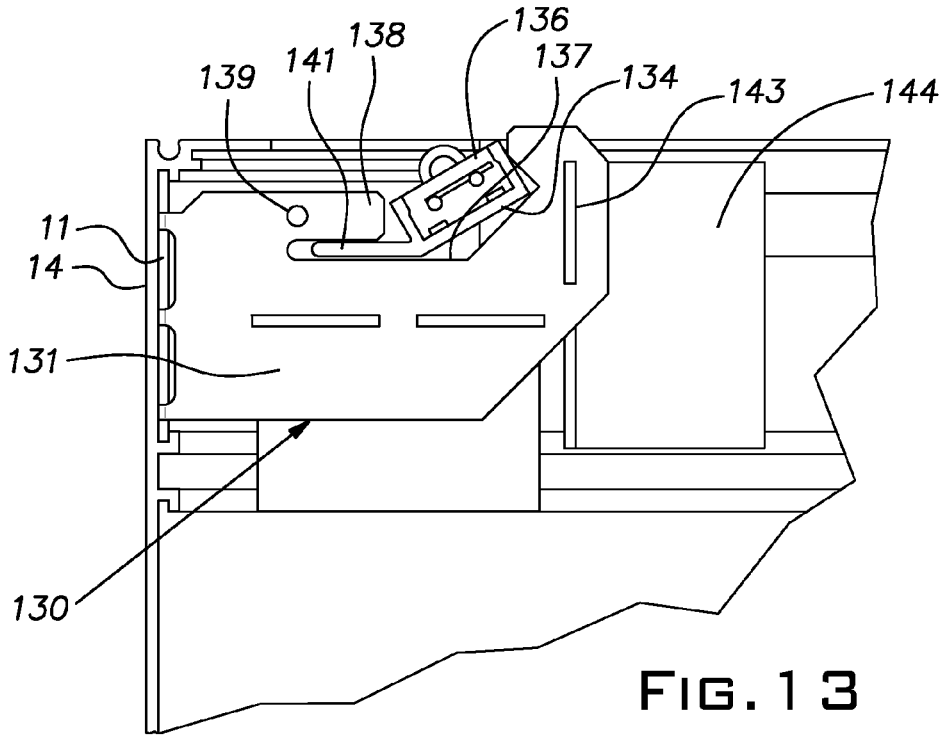
FIG. 13

CLIP FOR PERIMETER TRIM

BACKGROUND OF THE INVENTION

The invention relates to an improved clip for connecting architectural ceiling trim and various other building components.

Suspended ceiling systems can include so-called island ceilings and fascias where all or a part of a perimeter of a ceiling is spaced from any wall. Various trim products and related accessories have been developed to provide a finished look for these ceiling perimeters. One style of trim is an aluminum extrusion formed with mutually facing attachment channels integrated on a rear face of the extrusion.

With the availability of these trim elements and specialized accessories, there are opportunities to expand their use to other applications such as a wall treatment.

Clips have been devised to attach the perimeter trim to suspended ceiling grid runners. U.S. Pat. No. 7,930,864 discloses an example of the prior art. Prior art clips, particularly where they comprise multiple parts, can come apart when being assembled, can cause distortion of the trim if overly tightened, and can be expensive to manufacture. Thus, there has been a need for a one-piece inexpensive, easy to use clip for reliably attaching a trim element to a suspended ceiling grid. Additionally, a need has existed for a clip that can be used to mount accessories such as a lighting strip to the perimeter trim and can be used to mount the perimeter trim to a vertical surface such as a wall to provide a decorative feature.

SUMMARY OF THE INVENTION

The invention provides a one-piece clip arrangement for connecting a trim strip on a grid runner or other object or, alternatively, an accessory on the trim strip. The clip arrangement has a trim engaging part with a unique spring lock feature. The spring lock feature is deployed by positioning the part of a clip between opposed mounting channels of a trim strip while it is tilted and then turning it upright. The spring lock can be released with a simple reverse twist force applied with a flat blade screwdriver or like tool. Ideally, the clip is a one-piece sheet metal stamping. The spring lock results from a slot formation in the sheet metal that allows a section of the trim engaging part to work as a cantilever spring. The integral spring is configured so that it is compressed between the mounting channels of the trim strip when the clip is upright.

Preferably, the spring terminates in a relatively sharp trailing edge profile such that the spring exhibits a "one-way" locking action. The spring geometry allows the clip to readily turn into an upright installed position and in normal service resists a reversal of this twisting locking motion.

The trim strip engaging part of the clip can be integrated with a variety of alternative parts for mounting on various grid runner cross sections, on a flat surface, and for attaching accessories such as light bars.

BRIEF DESCRIPTION OF THE DRAWINGS

FIG. 1 is a perspective view of a universal trim strip mounting clip in accordance with a first embodiment of the invention;

FIG. 2 is a rear elevational view of the clip of FIG. 1;

FIG. 3 is an edge view of the clip of FIG. 1 mounted on a trim strip;

FIG. 12 is a perspective view of a sixth embodiment of the invention; and

FIG. 13 is a side elevational view of the clip of FIG. 12 supporting a light strip on a trim strip.

DESCRIPTION OF THE PREFERRED EMBODIMENTS

Figure 4:
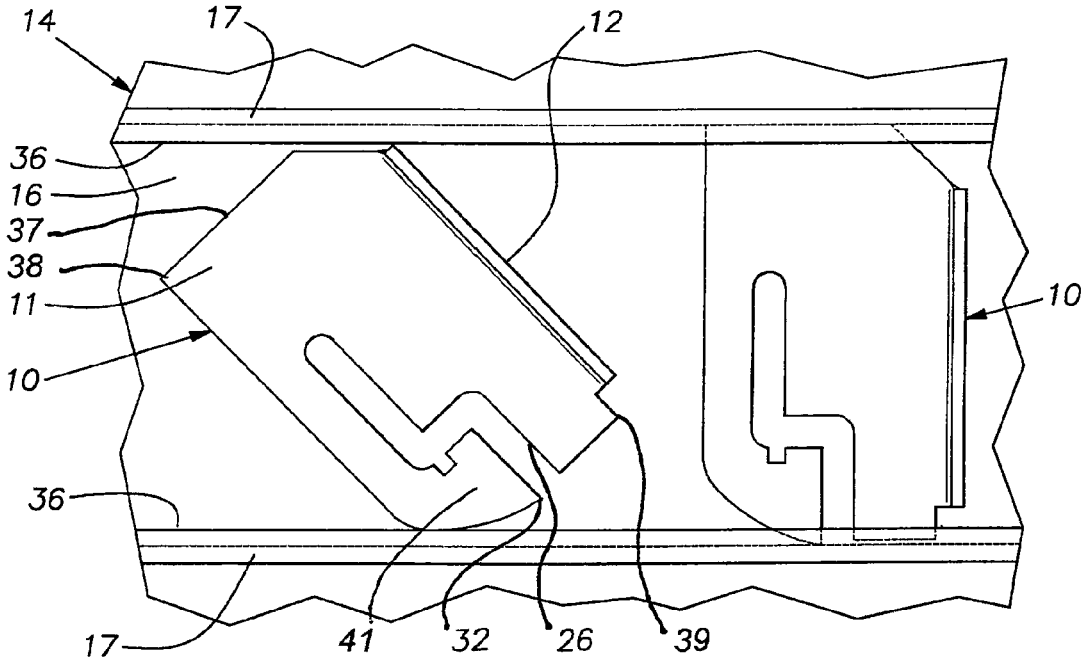
FIG. 4 is a rear view of a portion of a trim strip and the clip of FIG. 1 at the left tilted for assembly into channels of the trim strip, and at the right in an installed upright position.

FIGS. 1-4 illustrate a universal mounting clip 10 embodying the present invention. The clip 10 is preferably formed as a one-piece sheet metal stamping, made, for example, from hot dipped galvanized steel of a gauge of nominally 0.046 inches, for example. The clip 10, and the majority of clips disclosed hereafter, is bent into a right angle configuration after their various features have been blanked from sheet metal stock. The clip 10 has a planar trim engaging part 11 and a planar leg 12 extending at right angles to the part 11.

The clip 10 and other clips disclosed below are intended to be used with an extruded aluminum trim strip 14. The trim strip 14, on its rear side 16, includes a pair of opposed shallow channels 17; the open side of each channel faces the opposed channel. The width of the channels 17 can be slightly greater than the thickness of the sheet stock forming the clip 10. It will be understood that the channels 17 run the full length of the trim strip 14. The illustrated trim strip 14 is exemplary of commercially available trim strips used to provide finished edges on island ceilings and fascias and can be, for example, of the type marketed under the trademark COMPASSO® ELITE, a registered trademark of USG Interiors, LLC.

The profile of the part 11 is preferably the same as that employed in various other clips described hereinbelow. The profile can be described as generally rectangular with two of its diagonal corners modified so that when the clip is tilted from a vertical orientation, the part 12 will pass between the minimum space between the channels 17. FIG. 4 illustrates this circumstance on the left with the modified corners designated 18 and 19. A lower one of the clipped corners 19 is preferably rounded to provide an edge 21 which works as a cam surface as will be described.

A slot 26 extends from a mid-area of a lower edge 27 upwardly and laterally so that it overlies a part of the cam surface 21. In the illustrated construction, the slot 26 has an S-shape, being vertical at 28, horizontal at 29 and vertical at 30. A notch 31 in a lower side of the horizontal portion of the slot 26 is aligned with the vertical portion 30. A locking corner or point 32 is formed at the intersection of the slot 26 and the cam surface forming edge 21. The locking point 32 is relatively sharp so that it is capable of biting into the material of the trim strip 14. The part of the lower edge 27 on a side of the slot 26 away from the cam edge 21 and locking point 32 is slightly higher than the locking edge when the clip 10 is in a vertical orientation.

As demonstrated in FIG. 4, the diagonal length of the part 11 across the clipped corners 18, 19, is less than the spacing between the free edges, designated 36 of the trim channels 17. The clip is installed on a trim strip 14 by tilting it to the orientation illustrated on the left in FIG. 4 and positioning it between the channels 17. Thereafter, the clip is rotated upright so that its upper margin is captured in the upper channel 17 and, similarly, the lower edge 27 is captured in the lower channel 17. The part 11 is dimensioned so that the vertical distance between an upper edge 37 and the locking point 32 is, in a free state, slightly larger than the inside dimension between the opposed channels 17. The clip 10 can be rotated by grasping the leg 12 and/or by inserting a flat blade screwdriver or similar tool in the upper section 30 of the slot 26 and forcibly rotating the clip upright. When diagonal corners 38, 39 of the part 11 contact the base of the respective channel further rotation is arrested. Since the part is dimensioned with the locking point 32 slightly further from the upper edge 37 than the space between the channel bases, the locking edge will tend to bite into the relatively softer aluminum material of the trim strip 14 and will thereby lock the clip 10 in the upright position. The locking point 32 is spring loaded against the base of its respective channel 17 by the interference dimensioning of the part 12 relative to the spacing of the channels 17. Spring action on this locking point is the result of resilient distortion in the leg or peninsula, designated 41 created by the slot 26. This resilient distortion is analogous to a cantilever spring and is permitted by the width of the slot 26. The right angle or hook-like shape of the leg 41 augments vertical displacement of the locking point 32 relative to the remaining area of the part 11. Once installed upright, the clip 10 is held in position by the locking point 32 without free play and without longitudinal movement along the trim strip. Moreover, the upper and lower portions of the part 11 captured in the channel 17 afford a high force level resistance to pulling out of the channels perpendicularly to the plane of the trim strip 14.

The lock or bite of the point 32 can be released to shift the clip longitudinally in the channel 17 for adjustment purposes or for removal of the clip altogether. Release of the clip 10 can be readily accomplished by inserting the flat blade of a screwdriver in the vertical section 30 of the slot 26 with part of the blade in the notch 31. Rotation, counter-clockwise will flex the leg 41 enough to lift the locking point 32 from its grip on the respective channel 17 and continued rotation of the screwdriver will twist the clip 10 into the position of FIG. 4 from which it can be removed from between the channels 17.

The tightness of the clip 10 in the channels 17 can be increased by twisting a screwdriver with its blade in the vertical slot portion 30 clockwise so as to spread the leg 41 beyond its original spacing from the remainder of the part 11 so as to increase the distance between the locking point 32 and opposed upper edge 37.

The clip 10 is illustrated and described for purposes of disclosing a universal clip with a non-specific function of the leg or part 12. In the following disclosed embodiments, several clips are described having the same trim engaging part 11 as that of the clip 10. The various clip embodiments disclosed below are, again, one-piece constructions and have different legs or parts for connecting with specific elements or bodies. The function of the trim engaging part 11 in the below-described embodiments is the same as that set out above, including installation and removal.

Figure 5:
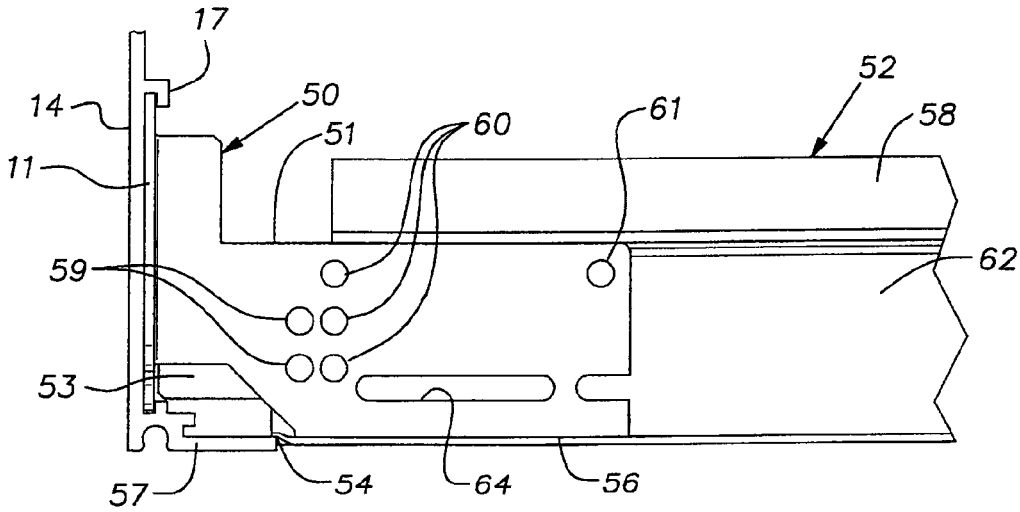
FIG. 5 is a side elevational view of a second embodiment of the invention connecting a trim strip to a grid runner or tee.
Figure 6:
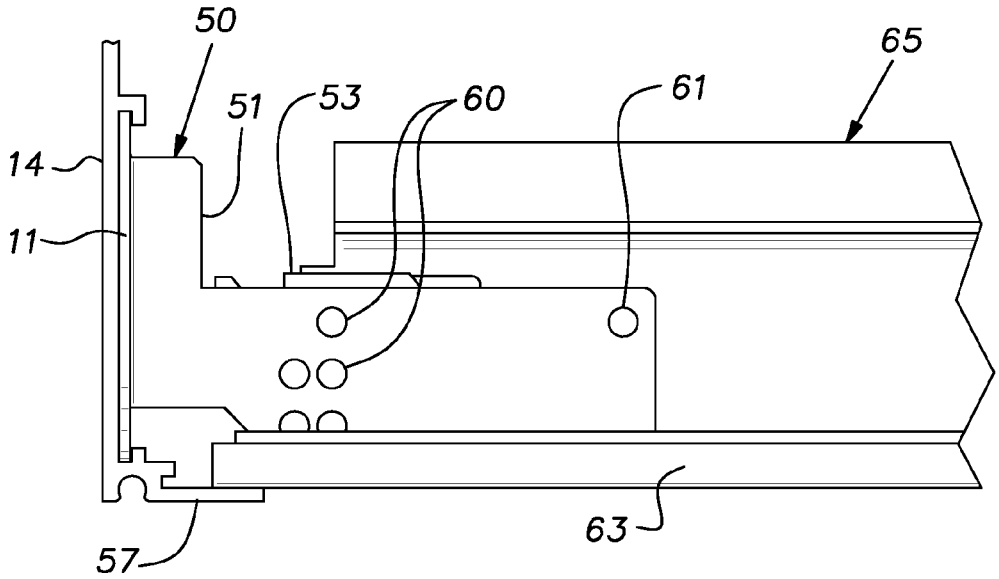
FIG. 6 is a side elevational view of the clip of FIG. 5 modified for use with a grid runner having a three dimensional flange.

FIGS. 5 and 6 illustrate a second embodiment of a clip 50 used to couple a trim strip 14 to suspended ceiling grid runners of various cross-section or profile. The clip 50 includes the described trim engaging part 11 and a grid member engaging part or leg 51. The horizontal length of the leg 51 is somewhat greater than that of the part 11 enabling the leg to lie alongside a grid runner 52 with an end of the runner spaced from the vertical part of the trim 14. More specifically, a standard length grid runner 52 with a standard end clip 53 can be accommodated by the clip 50 while a turned-up end 54 of a lower flange 56 is received on a lower runner flange 57 of the trim 14. It will be seen from FIG. 5 that the vertical height of the distal end of the clip leg 51 can be dimensioned to fit between the lower runner flange 56 and a runner reinforcing bulb 58 of a conventional grid tee such as the DX® or DXT style marketed by USG Interiors, LLC. The leg 51 is provided with sets of holes 59, 60 and 61 for attaching the clip 50 to the grid runner 52. For example, the holes 59 can be used with fasteners such as pop rivets or screws that are assembled in holes (not shown) in the grid runner 52 and end clip 53 that exist with the assembly of the grid runner and clip. Where the trim strip 14 is located "off-module", the grid runner 52 is cut to a proper length and the holes 60 and 61 can be used with screws or rivets assembled to the grid runner web 62.

Referring to FIG. 6, the clip 50 has been modified in the field by a technician for accommodating a grid runner 65 having a bulb style lower flange 63. An example of this style grid runner is the DXI product marketed by USG Interiors, LLC. A comparison of FIGS. 6 and 5 reveals that a lower portion of the clip leg 51 has been cut-off by a tin snips or like tool to remove clip material below the top edge of an elongated slot 64 (FIG. 5) to provide clearance for the vertically extending bulb style flange 63. Holes 60 can be used with pop rivets in the factory holes associated with an end connector 53 to fix the clip 50 to the grid runner 62.

Figure 7:
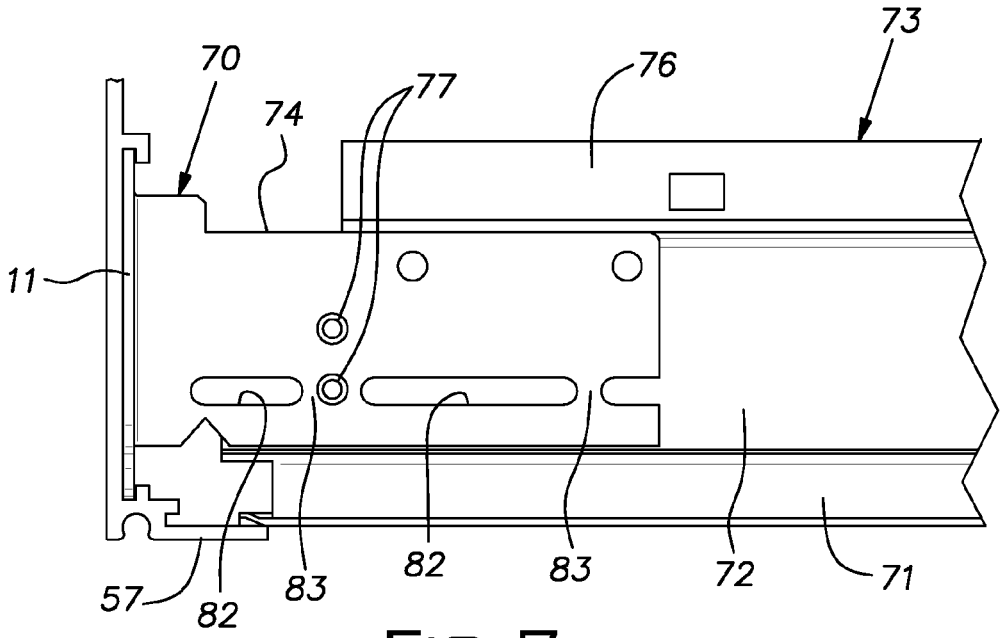
FIG. 7 is a side elevational view of a third embodiment of the invention connecting a trim strip to a grid runner with another style of three dimensional flange.
Figure 8:
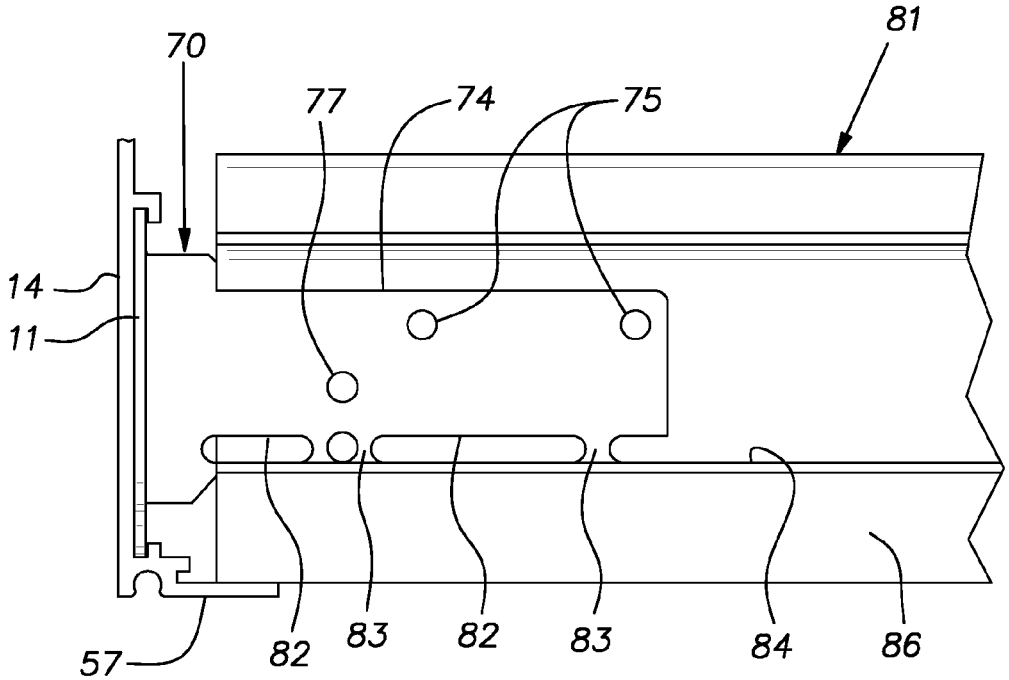
FIG. 8 is a side elevational view of the clip of FIG. 7 modified for use with a drywall grid tee and ½ inch drywall.
Figure 9:
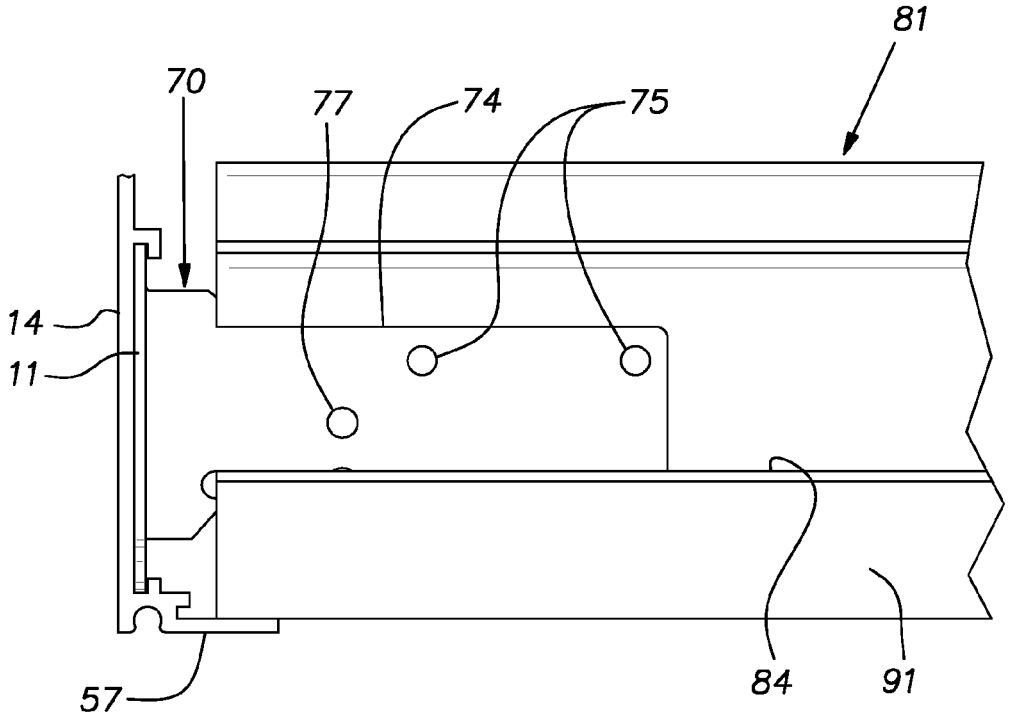
FIG. 9 is a side elevational view of the clip of FIG. 7 modified for use with a drywall grid tee and ⅝ inch drywall.

FIGS. 7-9 illustrate another clip 70 useful with a variety of grid runners. In FIG. 7, there is illustrated a grid runner 73 of the screw slot type wherein a lower flange 71 forms a hollow box-like structure with an open slot centered below a web 72 of the grid runner. By way of example, the grid runner 73 may be of the type marketed under the mark DXF/DXLF by USG Interiors, LLC, and is shown in profile in FIG. 10.

As manufactured, the clip 70 has a part or leg 74 proportioned to fit on the web 72 between the slot forming flange 71 and a reinforcing bulb 76. A pair of holes 77 are provided to register in the rivet holes at which a connector on the end of the grid runner 73 is attached. Rivets or screws can be assembled in the holes 77 to attach the leg 74 to the grid runner 73. Auxiliary holes can optionally be used for fastening the clip 70 to a grid runner. FIG. 7 illustrates the relationship of the leg 74 to the trim engaging part 11 that registers a lower face of the flange 71 with an upper side of the trim flange 57.

FIG. 8 illustrates the scrim clip 70 connected with a drywall grid tee 81. The clip 70 in FIG. 8 has been modified in the field by a technician erecting a suspended drywall ceiling. It will be seen that, in FIG. 8, a lower part of the leg 74 is cutaway with a tin snips or other tool at the lower sides of a series of horizontal slots 82 originally formed in the clip 70 during its manufacture. The leg 74 is proportioned so that when trimmed in the manner illustrated in FIG. 8, land areas 83 at the end of the slots 82 rest on a flange 84 of the grid tee 81. In this position relative to the grid tee 81, the modified clip supports the trim strip 14 so that ½ inch drywall 86 is accommodated with a close fit on the upper face of the trim flange 57. Screws or other fasteners are assembled in holes in the part 74 to fix the clip 70 to the web of the tee 81.

Referring now to FIG. 9, the clip 70 can be modified to connect a trim strip 14 to a suspended ceiling drywall grid tee 81 being used with ⅝ inch drywall 91. The clip 70 is modified by cutting the bottom side of the leg 74 at the level of upper edges 92 of the horizontal slots 82. When the upper edges 92 of the horizontal slots rest against the upper side of the grid tee flange 84, ⅝ inch drywall 91 fits closely on the upper side of the trim flange 57. It will be seen that a number of holes remain in the clip part 74 to receive fasteners such as screws or pop rivets to attach the part to the web of the grid tee 81.

Figure 10:
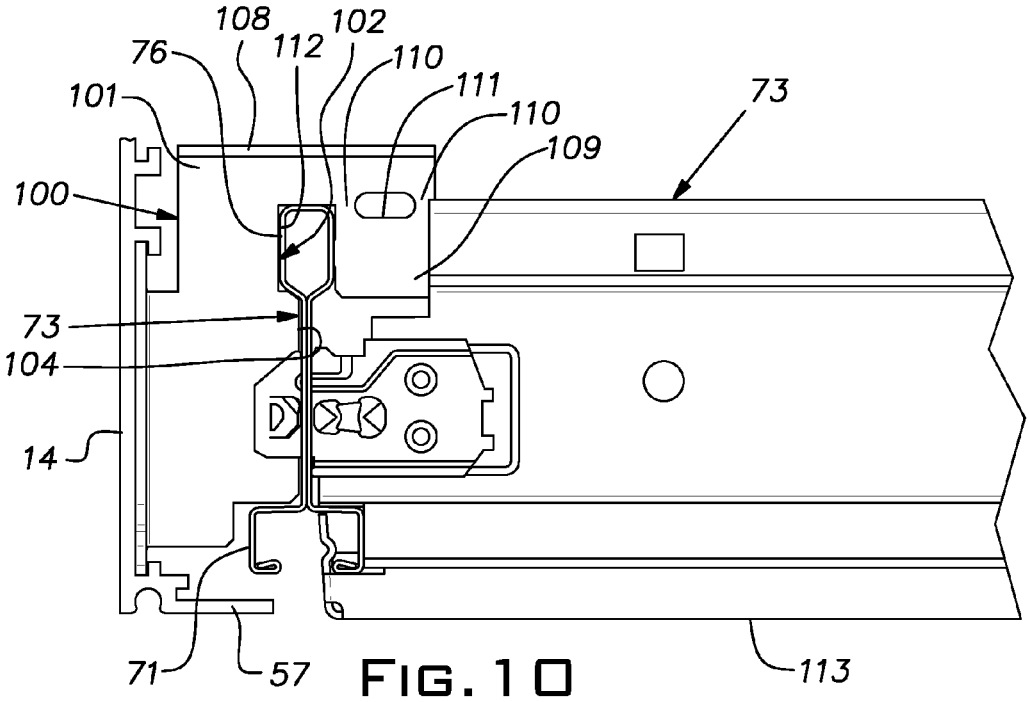
FIG. 10 is a side elevational view of a fourth embodiment of the invention connecting a trim strip to a parallel grid runner.

FIG. 10 illustrates another embodiment of the clip 100. The clip 100 includes a part or leg 101 that has an edge configuration 102 adapted to engage the profile of a slotted flange style grid runner 73. As shown in FIG. 10, the clip leg profile or edge 102 generally conforms to one side of the grid runner 73 including a portion 104 that closely fits between a flange 71 and reinforcing bulb 76.

The part 101 is generally planar with the exception of a flange 108 bent at right angles in the same direction as the trim engaging part 11. A tab 109 is connected to the main body of the part 101 by webs 110 on opposite sides of a slot 111 punched into the body of the part 101. The presence of the slot 111 allows the tab 109 to be bent upwardly, i.e. towards the stiffening flange 108 manually with a pair of pliers. The tab 109 is temporarily bent out of the plane of the part 101 to allow the reinforcing bulb 76 to be located in a receiving area 112. The receiving area 112 is shaped to closely confine the bulb 76 when the tab 109 is bent back to its original orientation coplanar with the remaining of the part 101. The grid runner 73 is supported in parallel relation to the trim strip 14 by a plurality of identical clips 100 spaced along the length of the trim strip. The clips 100 by virtue of the profile 102 hold the grid runner 103 at an elevation such that a pan-like panel 113 snapped in the slot of the grid runner flange 73 is flush with the flange 57 of the trim strip 14. FIG. 10 illustrates a cross runner 73 having an end connector inserted in a slot in a web of the grid runner 73 running parallel to the trim strip 14.

Figure 11:
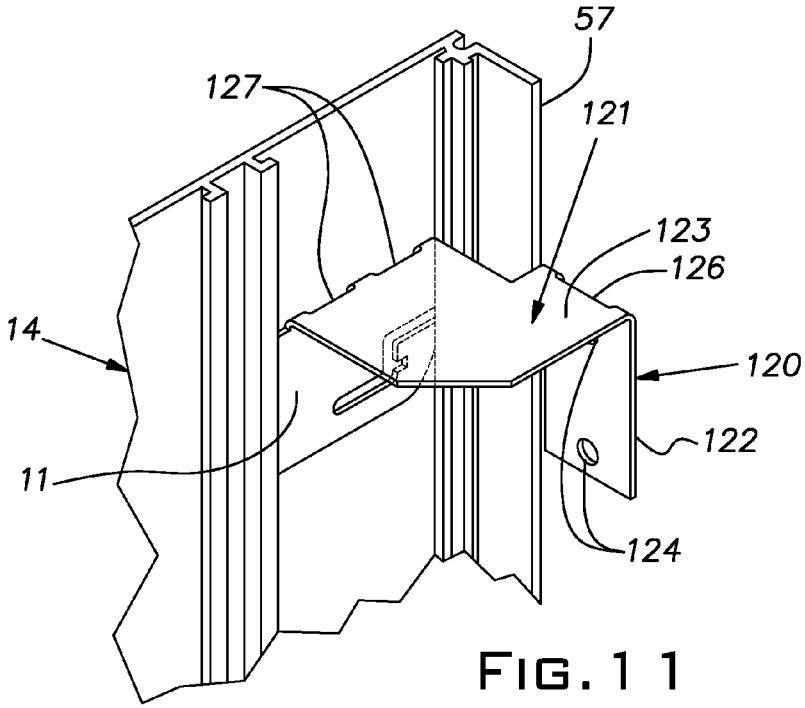
FIG. 11 is a perspective view of a fifth embodiment of the invention for mounting the trim strip on a flat surface such as a wall.

FIG. 11 illustrates a clip 120 of still another embodiment that can be used to mount a trim strip 14 on a surface of a structure such as a vertical wall. A part 121 of the clip 120 joined to the trim engaging part 11 is three dimensional in the sense that a distal section 122 is at right angles to a plane of a section 123 proximal to the trim engaging part 11. The distal section 122 includes a pair of holes 124 adapted to receive screws or other fasteners to secure the clip 120 to a mounting surface such as that provided by a vertical wall.

The distal and proximal sections 122, 123 are separated by an elongated slot 126 and, similarly, the proximal section and trim engaging part 11 are separated by a pair of aligned elongated slots 127. The clip 120 can be manufactured and distributed in a flat configuration and can be bent along its lines of the slots 126, 127 into the orthogonal configuration illustrated in FIG. 11 or into a mirrored configuration by the technician installing the trim strip 14. The clip 120 can be used to mount a trim strip 14 on a wall to construct a three dimensional wall mounting or a light box, for example.

FIGS. 12 and 13 illustrate a clip 130 which is intended to mount hardware on a trim strip 14, as opposed to the above disclosed clips serving to mount a trim strip on hardware. The clip 130 includes a part 131 connected to the trim engaging part 11 with land areas 132 formed by a pair of elongated, aligned slots 133. The limited length of the land areas 132 enable the clip 130 to be manually bent by a technician in the field. The clip can be manufactured and distributed in a flat condition; note that the trim engaging part 11 can be bent to the left or right of the hardware mounting part 131. The part 131 is configured, as shown in FIG. 13, to receive an extrusion 134 which can be part of a commercially available light bar 136 carrying LED lamps. The clip part 131 includes a cut-out 137 configured to receive the extrusion 134. A tab 138 can be bent out of the plane of the part 131 at a line or zone weakened by a hole 139 in order to receive a leg 141 of the extrusion 134. When the extrusion 134 is fully received within the cutout 137, the tab 138 can be bent back into the plane of the part 131 to capture the extrusion 134 in the cutout 137. The part 131 is manufactured with narrow slots 142 to receive mounting tabs 143 of a power supply 144 associated with the light bar 136. Two or more clips 130, spaced along a trim strip 14 are used to support the extrusion 134 and the power supply 144.

While the invention has been shown and described with respect to particular embodiments thereof, this is for the purpose of illustration rather than limitation, and other variations and modifications of the specific embodiments herein shown and described will be apparent to those skilled in the art all within the intended spirit and scope of the invention. Accordingly, the patent is not to be limited in scope and effect to the specific embodiments herein shown and described nor in any other way that is inconsistent with the extent to which the progress in the art has been advanced by the invention.

What is claimed is:

1. A sheet metal clip for fixing an elongated trim strip with opposed receiving channels to another object comprising a one-piece sheet metal body having a planar trim engaging part and an object engaging part extending or extendable at a right angle from the trim engaging part, the trim engaging part having an oblong profile with a long dimension and a diagonal dimension shorter than the long dimension whereby the trim engaging part can pass between opposed receiving channels when the diagonal profile dimension is perpendicular to a longitudinal direction of the trim strip and is restrained in the channels when the long dimension is perpendicular to the longitudinal direction of the trim strip, a slot in the trim engaging part constructed and arranged to produce a spring section that is resiliently deflected when the trim engaging part is received in the channels with its long dimension rotated perpendicular to the trim strip longitudinal direction wherein the spring section has a sharp corner projecting lower than an otherwise lowermost edge of the clip and disposed to engage a base wall within a channel when the trim engaging portion is perpendicular to the longitudinal direction of the trim strip.

2. A clip as set forth in claim 1, wherein the slot overlies the sharp corner.

3. A clip as set forth in claim 2, wherein the slot includes perpendicular sections.

4. A clip as set forth in claim 1, including a notch in the spring section adapted to receive a flat blade screwdriver and effective to retract the sharp corner away from the channel wall when the screwdriver is twisted.

* * * * *